US008334471B2

(12) United States Patent
Zhao et al.

(10) Patent No.: US 8,334,471 B2
(45) Date of Patent: Dec. 18, 2012

(54) PUSH BUTTON SWITCH

(75) Inventors: Kenneth Zhao, Taipei Hsien (TW); Chi-Hsien Fong, Taipei Hsien (TW); Pu Zhao, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 285 days.

(21) Appl. No.: 12/845,714

(22) Filed: Jul. 28, 2010

(65) Prior Publication Data

US 2011/0186409 A1 Aug. 4, 2011

(30) Foreign Application Priority Data

Feb. 3, 2010 (CN) ..... 2010 1 0301151

(51) Int. Cl.
*H01H 9/00* (2006.01)

(52) U.S. Cl. ..... 200/314

(58) Field of Classification Search ..... 200/314, 200/310, 341; 362/602, 24–27
See application file for complete search history.

(56) References Cited

U.S. PATENT DOCUMENTS

| | | | | |
|---|---|---|---|---|
| 5,568,367 | A * | 10/1996 | Park | 362/109 |
| 5,664,667 | A * | 9/1997 | Kenmochi | 200/314 |
| 6,997,572 | B2 * | 2/2006 | Ono et al. | 362/24 |
| 7,193,170 | B2 * | 3/2007 | Katayama et al. | 200/314 |
| 7,253,369 | B2 * | 8/2007 | Fu et al. | 200/310 |
| 7,283,066 | B2 * | 10/2007 | Shipman | 341/22 |
| 7,335,843 | B2 * | 2/2008 | Chan et al. | 200/310 |
| 7,677,781 | B2 * | 3/2010 | Ishihara et al. | 362/602 |

FOREIGN PATENT DOCUMENTS

TW I1283421 B1 7/2007

* cited by examiner

*Primary Examiner* — Xuong Chung Trans
(74) *Attorney, Agent, or Firm* — Altis Law Group, Inc.

(57) ABSTRACT

A push button switch includes a light emitter, a switch, a base, a light guiding member and a button. The light emitter and the switch are arranged on the circuit board. The base is arranged above the switch. The light guiding member and the button are mounted on the base. The light guiding member includes a first end, a second end, a first reflective surface, and a second reflective surface, the first end being arranged above the light emitter, wherein light from the light emitter enters into the light guiding member from the first end, and goes to the second end after being reflected by the first reflective surface and the second reflective surface.

12 Claims, 5 Drawing Sheets

PUSH BUTTON SWITCH

BACKGROUND

1. Technical Field

The present disclosure relates to push button switches and, particularly, to a push button switch including a light guiding member, a button, and a switch.

2. Description of Related Art

Electronic devices, such as LCD displays, usually include a push button switch. The push button switch usually includes a push button projects from the front of a housing, and a switch inside the housing that can be actuated by depressing the push button. The face of the push button can be illuminated from the rear to indicate an ON/OFF state of the electronic device. Although the conventional switch satisfies the basic requirements, it is still desirable to provide a novel push button switch.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
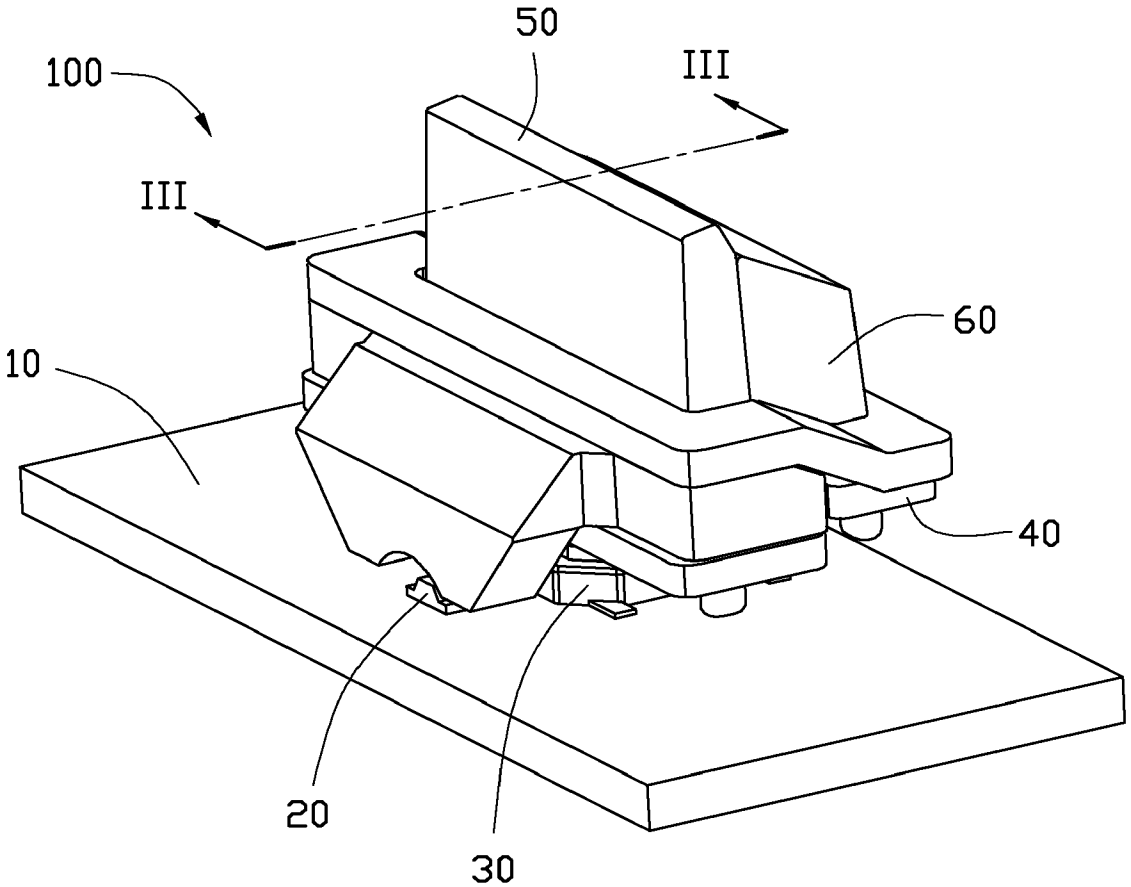
FIG. 1 is a schematic, isometric view of a push button switch according to an exemplary embodiment.

Referring to FIG. 1, a push button switch 100, according to an exemplary embodiment, includes a circuit board 10, a light emitter 20, a switch 30, a base 40, a light guiding member 50, and a button 60. The light emitter 20 and the switch 30 are fixed on the circuit board 10. In the embodiment, the light emitter 20 and the switch 30 are arranged on the circuit board 10 abreast (see FIG. 3). The base 40 is arranged above the switch 30, and may be connected to the circuit board 10 via one or more elastic members, such as springs (not shown), allowing the base 40 to return to its original position from a pushed-down position after external force applied thereon is removed. A small gap is formed between the base 40 and the switch 30.

Figure 2:
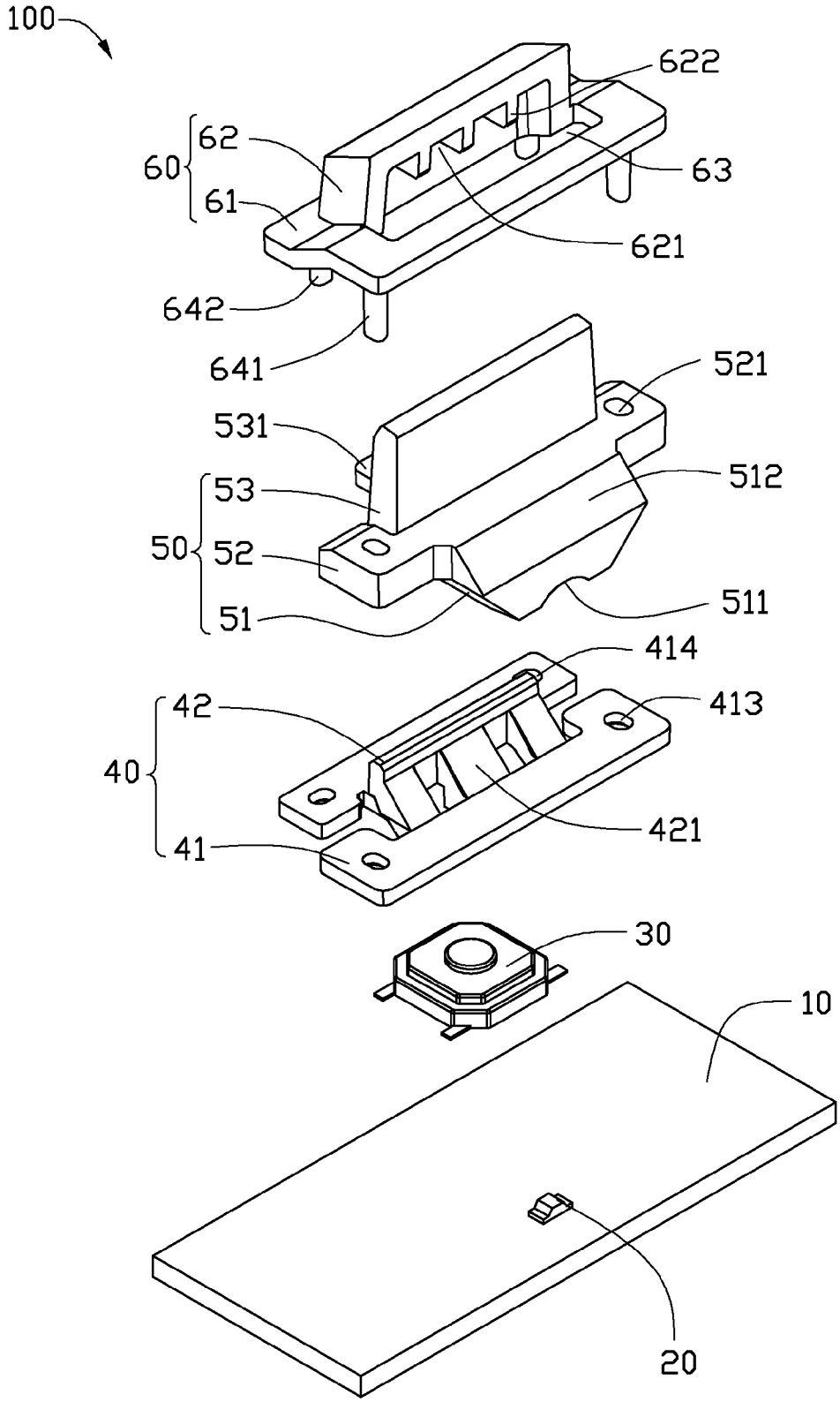
FIG. 2 is an exploded view of the push button switch of FIG. 1.

Referring to FIG. 2, the button 60 includes a fixing member 61 and a pressing member 62 stacked on the fixing member 61. The fixing member 61 and the pressing member 62 cooperate to define a cavity 621 and a slot 63. A number of reinforcing ribs 622 protrude downwards from the ceiling of the cavity 621 that faces the slot 63. A pair of first positioning posts 641 and a pair of second positioning posts 642 protrude downwards from a bottom of the fixing member 61. The positioning posts 641 are longer than the positioning posts 642.

The light guiding member 50 can be made of polycarbonate or polymethyl methacrylate and includes a first light guiding element 51, a second light guiding element 52, and a third light guiding element 53. The first light guiding element 51 includes an end that defines a recess 511 that is positioned above the light emitter 20. The first light guiding element 51 also includes a sloped reflective surface 512.

Figure 3:
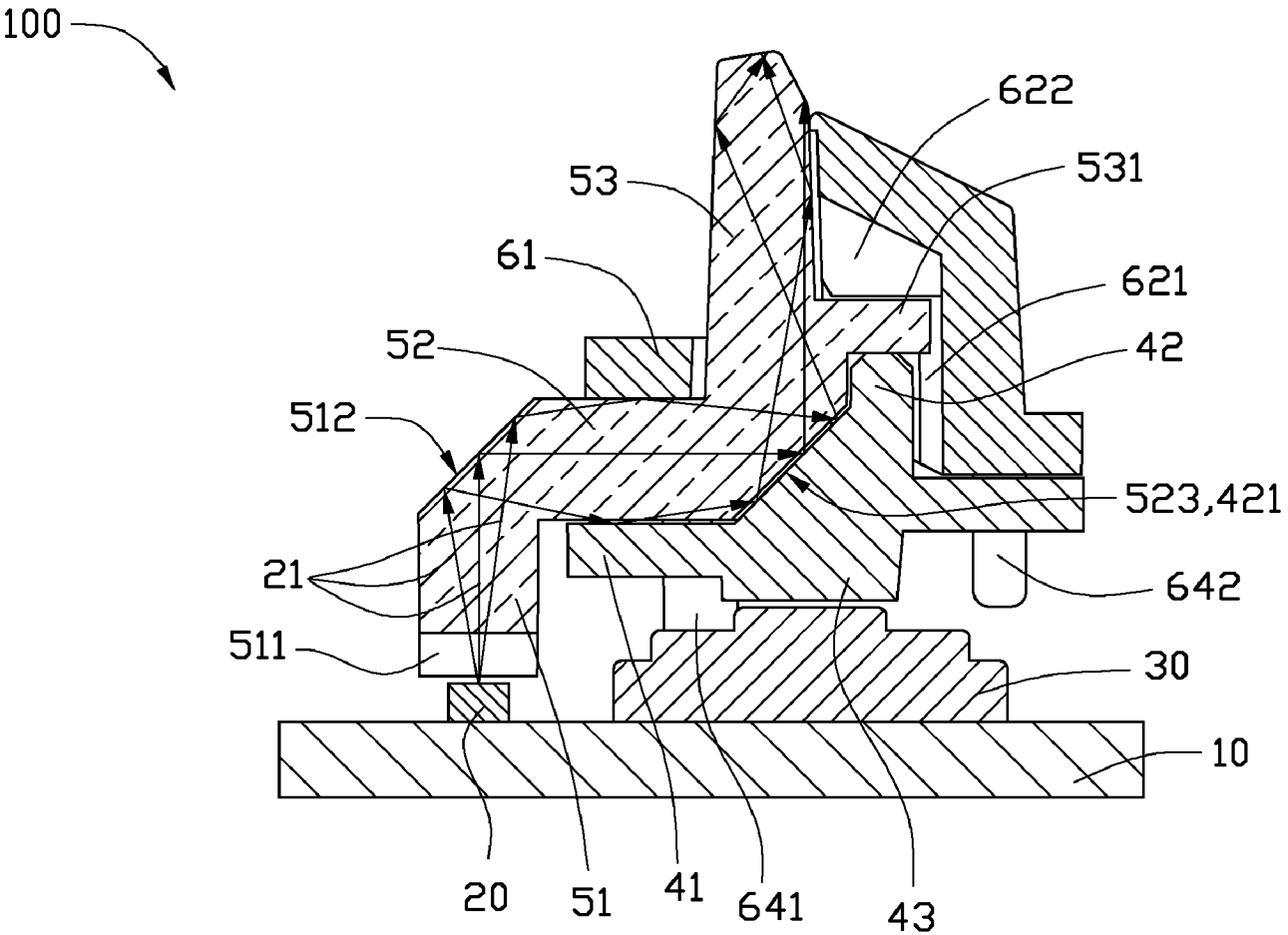
FIG. 3 is a cross-sectional view taken along line III-III of FIG. 1.

Referring also to FIG. 3, the second light guiding element 52 is substantially perpendicular to the first light guiding element 51, and includes a sloped reflective surface 523. The reflective surface 512 opposes and is substantially parallel to the reflective surface 523. The third light guiding element 53 is substantially parallel to the first light guiding element 51, but is arranged at an opposite side of the second light guiding element 52 from the first light guiding element 51. When the light beam 21 emitted by the light emitter 20 enters the first light guiding element 51 from the recess 511, the reflective surface 512 reflects the light beam 21 to the second light guiding element 52, and the reflective surface 523 reflects the light beam 21 to the third light guiding element 53. After being reflected several times, the light beam 21 emanates from an end of the third light guiding element 53. The light guiding member 50 thus boasts high uniformity of light emission.

In order to shorten the optical transmission path and improve efficient utilization ratio of light, the reflective surface 512 and the reflective surface 523 are both 45 degrees with respect to the second light guiding element 52.

The second light guiding element 52 further defines a pair of first locating holes 521 that match the first positioning posts 641. The third light guiding element 53 is shaped to pass through the slot 63. A protruding tab 531 protrudes from and is substantially perpendicular to the third light guiding element 53. The protruding tab 531 is in the same side as the reflective surface 523.

When in assembly, each positioning post 641 passes through a first locating hole 521. The third light guiding element 53 passing through the slot 63 with the protruding tab 531 is received in the cavity 621 and abuts against the reinforcing rib 622. The fixing member 61 rests on the second light guiding element 52. After assembly, the button 60 and the light guiding member 50 are assembled together.

Figure 4:
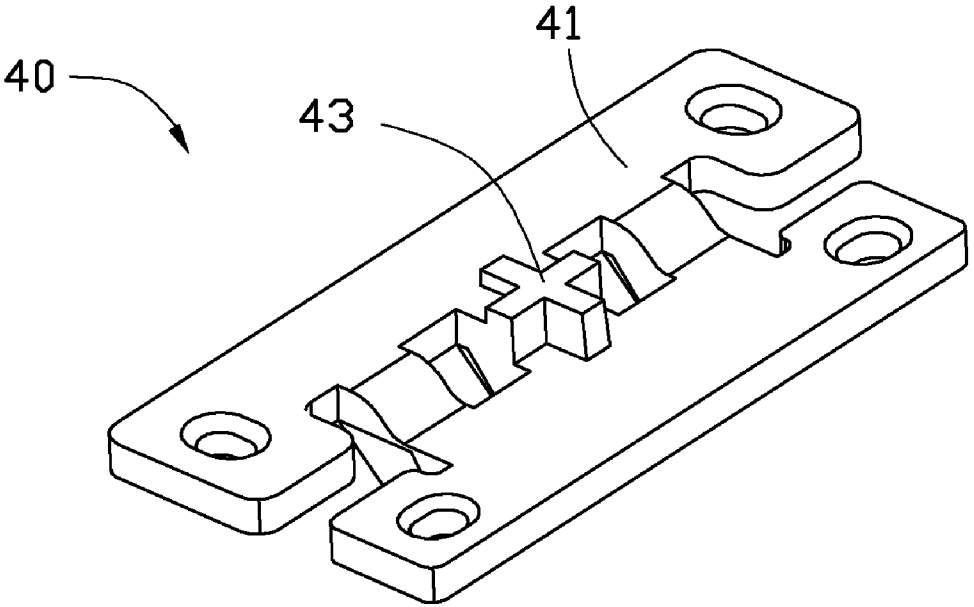
FIG. 4 is a schematic, isometric view of a base of FIG. 2.

The base 40 includes a connecting member 41 and a supporting member 42. The connecting member 41 defines a pair of second locating holes 413 that match the first positioning posts 641, and a pair of third locating holes 414 that match the second positioning posts 642. The supporting member 42 protrudes from the connecting member 41. The supporting member 42 includes a sloped surface 421 (see FIG. 2) sloped about 45 degrees with respect to the connecting member 41. Referring also to FIG. 4, a resisting portion 43 protrudes from a bottom of the connecting member 41, and is used to actuate the switch 30.

Each first positioning post 641 passes through a second locating hole 413, and each second positioning post 642 passes through a third locating hole 414 to connect the base to the button 60. The supporting member 42 is received in the cavity 621 and sustains the protruding tab 531. The sloped surface 421 is substantially parallel to and abuts against the reflective surface 523. The connecting member 41 sustains the second light guiding element 52.

Figure 5:
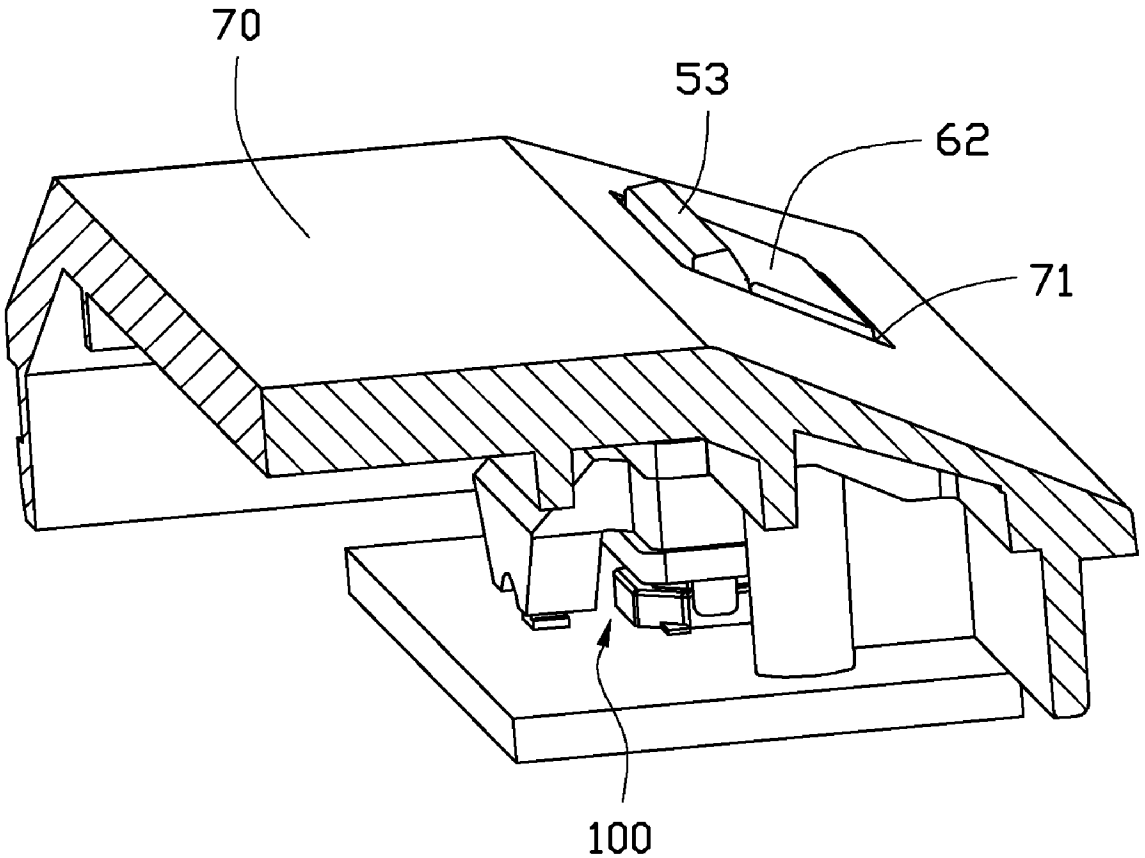
FIG. 5 is a partial, cut-away view showing the push button switch housed by a housing.

Referring to FIG. 5, the push button switch 100 can be housed by a housing 70 of an electronic device (not shown). The housing 70 is fixed to a casing (not shown) of the electronic device, and defines a through hole 71. The ends of the pressing member 62 and the third light guiding element 53 are received in the through hole 71, such that a user can depress the pressing member 62 and the light from the third light guiding element 53 can be caught.

When the pressing member 62 is depressed, the protruding tab 531 is pushed to engage the supporting member 42. The resisting portion 43 thus moves and actuates the switch 30. A circuit (not shown) is closed/opened alternately to turn on/off the light emitter 20, to indicate the power on/off state of the electronic device.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A push button switch comprising:

a circuit board;

a light emitter and a switch arranged on the circuit board;

a base arranged above the switch; and a light guiding member and a button mounted on the base, the light guiding member comprising a first end, a second end, a first reflective surface, a second reflective surface, and a protruding tab protruding from the light guiding member, the first end being arranged above the light emitter, wherein light from the light emitter enters the light guiding member from the first end, and goes to the second end after being reflected by the first reflective surface and the second reflective surface;

the button comprising a fixing member and a pressing member stacked on the fixing member, wherein the fixing member and the pressing member cooperate to define a cavity, a plurality of reinforcing ribs protrude downwards from the ceiling of the cavity, and the protruding tab is received in the cavity and abuts against the reinforcing rib.

2. The push button switch of claim 1, wherein the first end defines a recess positioned above the light emitter.

3. The push button switch of claim 1, wherein the light guiding member comprises a first light guiding element, a second light guiding element, and a third light guiding element, the first reflective surface is formed on the first light guiding element, the second reflective surface is formed on the second light guiding element.

4. The push button switch of claim 3, wherein the second light guiding element is substantially perpendicular to the first light guiding element; the third light guiding element is substantially parallel to the first light guiding element, but is arranged at an opposite side of the second light guiding element from the first light guiding element.

5. The push button switch of claim 3, wherein the fixing member and the pressing member cooperate to define a slot; the third light guiding element is shaped to pass through the slot.

6. The push button switch of claim 3, wherein the protruding tab protrudes from and is substantially perpendicular to the third light guiding element.

7. The push button switch of claim 6, wherein the base comprises a connecting member and a supporting member protruding from the connecting member; the supporting member is received in the cavity and sustains the protruding tab.

8. The push button switch of claim 7, wherein the supporting member includes a sloped surface, the sloped surface is substantially parallel to and abuts against the second reflective surface, the first reflective surface opposes and is substantially parallel to the second reflective surface.

9. The push button switch of claim 8, wherein the first reflective surface and the second reflective surface are both 45 degrees with respect to the second light guiding element, the sloped surface is sloped about 45 degrees with respect to the connecting member.

10. The push button switch of claim 7, wherein a resisting portion protrudes from a bottom of the connecting member, and is used to actuate the switch.

11. The push button switch of claim 7, wherein a pair of first positioning posts and a pair second positioning posts protrude downwards from a bottom of the fixing member; the second light guiding element defines a pair of first locating holes that match the first positioning posts; the connecting member defines a pair of second locating holes that match the first positioning posts, and a pair of third locating holes that match the second positioning posts; each first positioning post passes through a first locating hole and a second locating hole in turn, and each second positioning post passes through a third locating hole, connecting the button and the light guiding member to the base.

12. The push button switch of claim 5, the push button switch can be housed by a housing of an electronic device, the housing defines a through hole to receive the ends of the pressing member and the third light guiding element.

* * * * *